US006645264B2

(12) United States Patent
Hasegawa et al.

(10) Patent No.: US 6,645,264 B2
(45) Date of Patent: Nov. 11, 2003

(54) COMPOSITION FOR FORMING POLISHING PAD, CROSSLINKED BODY FOR POLISHING PAD, POLISHING PAD USING THE SAME AND METHOD FOR PRODUCING THEREOF

(75) Inventors: Kou Hasegawa, Tokyo (JP); Tomoo Koumura, Tokyo (JP); Yutaka Kobayashi, Tokyo (JP)

(73) Assignee: JSR Corporation, Tokyo (JP)

( * ) Notice: Subject to any disclaimer, the term of this patent is extended or adjusted under 35 U.S.C. 154(b) by 30 days.

(21) Appl. No.: 09/983,097

(22) Filed: Oct. 23, 2001

(65) Prior Publication Data

US 2002/0078632 A1 Jun. 27, 2002

(30) Foreign Application Priority Data

Oct. 24, 2000 (JP) ..... 2000-324139

(51) Int. Cl.[7] ..... C09K 3/22

(52) U.S. Cl. ..... 51/299; 428/542; 451/548; 51/302

(58) Field of Search ..... 428/542; 51/299, 51/302; 451/548

(56) References Cited

U.S. PATENT DOCUMENTS 6,390,890 B1 * 5/2002 Molnar ..... 451/41

FOREIGN PATENT DOCUMENTS

| | | |
|---|---|---|
| JP | 11-322877 | 11/1999 |
| JP | 2000-263423 | 9/2000 |

OTHER PUBLICATIONS

U.S. patent application Ser. No. 09/867,541, Ogawa et al., filed May 31, 2001.

U.S. patent application Ser. No. 10/030,141, Hasegawa et al., filed Jan. 28, 2002.

U.S. patent application Ser. No. 10/128,282, Hasegawa, filed Apr. 24, 2002.

U.S. patent application Ser. No. 10/252,696, Hasegawa et al., filed Sep. 24, 2002.

U.S. patent application Ser. No. 10/279,843, Konno et al., Oct. 25, 2002.

U.S. patent application Ser. No. 09/995,613, Hasegawa, Nov. 29, 2001.

* cited by examiner

*Primary Examiner*—Robert Dawson
*Assistant Examiner*—D. Aylward
(74) *Attorney, Agent, or Firm*—Oblon, Spivak, McClelland, Maier & Neustadt, P.C.

(57) ABSTRACT

It is an object of the invention to provide a composition for forming a polishing pad comprising substances having specific functional groups exhibiting excellent hydrophilic properties and the like, a crosslinked body for polishing pad as well as a polishing pad with excellent water resisting and durability which exhibits excellent polishing performance including a high removal rate and method for producing thereof. The composition for forming a polishing pad comprises a crosslinkable elastomer having no carboxyl, amino, hydroxyl, epoxy, sulfonic acid and phosphoric acid groups, and a water-insoluble substance having at least one functional group selected from the group consisting of carboxyl, amino, hydroxyl, epoxy, sulfonic acid and phosphoric acid groups. And a water-soluble substance such as cyclodextrin may be contained. A polishing pad can be manufactured using the composition above or the crosslinked body for polishing pad, and porous polishing pads may also be obtained.

31 Claims, No Drawings

COMPOSITION FOR FORMING POLISHING PAD, CROSSLINKED BODY FOR POLISHING PAD, POLISHING PAD USING THE SAME AND METHOD FOR PRODUCING THEREOF

FIELD OF THE INVENTION

The present invention relates to a composition for forming a polishing pad, a crosslinked body for a polishing pad, a polishing pad using the same and a method for producing thereof. The polishing pad in the invention is suitable for polishing of the surface of semiconductor wafer and the like.

DESCRIPTION OF THE RELATED ART

As a method for polishing which can form the surface having the high flatness, an attention has been recently paid to CMP (Chemical Mechanical Polishing). Polishing in CMP is accomplished by sliding the polishing pad against the polishing surface while allowing a slurry of abrasive particles in an aqueous dispersion to flow from the polishing pad surface.

In CMP, the removal rate is a major factor controlling productivity, and it is known that the removal rate can be vastly improved by increasing the retention of the slurry above the conventional level.

Polishing pads for CMP have conventionally been made of foamed polyurethane having pores formed to a size of a few tens of micrometers, and the use of polyurethane introduces the problem of durability of the pad because of its generally poor water resisting. On the other hand, when using an elastomer such as butadiene rubber which has excellent water resisting, the problem of low removal rate due to reduced moisture wettability is introduced.

SUMMARY OF THE INVENTION

It is an object of the present invention, which has been accomplished in light of these circumstances, to provide a composition for forming a polishing pad comprising substances having specific functional groups exhibiting excellent hydrophilic properties and the like, a crosslinked body for polishing pad as well as a polishing pad with excellent water resisting and durability which exhibits excellent polishing performance including a high removal rate and method for producing thereof.

The present invention will now be explained in detail.

1. A composition for forming a polishing pad comprising [A] a crosslinkable elastomer having no carboxyl, amino, hydroxyl, epoxy, sulfonic acid and phosphoric acid groups and [B] a water-insoluble substance having at least one functional group selected from the group consisting of carboxyl, amino, hydroxyl, epoxy, sulfonic acid and phosphoric acid groups.

2. The composition for forming a polishing pad according to 1 above, wherein the amount of [A] is 40 to 99.9 wt % and the amount of [B] is 0.1 to 60 wt %, based on 100 wt % of the total of [A] and [B].

3. The composition for forming a polishing pad according to 1 above, further comprising [C] a water-soluble substance.

4. The composition for forming a polishing pad according to 3 above, wherein the amount of [C] is 5 to 50 vol % based on 100 vol % of the total of [A], [B] and [C].

5. The composition for forming a polishing pad according to 4 above, wherein the above-mentioned crosslinkable elastomer is 1,2-polybutadiene.

6. The composition for forming a polishing pad according to 4 above, wherein [C] is cyclodextrin.

7. A crosslinked body for a polishing pad produced by using the composition for forming a polishing pad which is comprising [A] a crosslinkable elastomer having no carboxyl, amino, hydroxyl, epoxy, sulfonic acid and phosphoric acid groups and [B] a water-insoluble substance having at least one functional group selected from the group consisting of carboxyl, amino, hydroxyl, epoxy, sulfonic acid and phosphoric acid groups.

8. The crosslinked body for a polishing pad according to 7 above, further containing [C] a water-soluble substance in the above-mentioned composition for forming a polishing pad.

9. A polishing pad produced by using the composition for forming a polishing pad which is comprising [A] a crosslinkable elastomer having no carboxyl, amino, hydroxyl, epoxy, sulfonic acid and phosphoric acid groups and [B] a water-insoluble substance having at least one functional group selected from the group consisting of carboxyl, amino, hydroxyl, epoxy, sulfonic acid and phosphoric acid groups.

10. The polishing pad according to 9 above, wherein the amount of [A] is 40 to 99.9 wt % and the amount of [B] is 0.1 to 60 wt %, based on 100 wt % of the total of [A] and [B].

11. The polishing pad according to 10 above, wherein the above-mentioned crosslinkable elastomer is 1,2-polybutadiene.

12. The polishing pad according to 9 above, further containing [C] a water-soluble substance in the above-mentioned composition for forming a polishing pad.

13. The polishing pad according to 12 above, wherein the amount of [C] is 5 to 50 vol % based on 100 vol % of the total of [A], [B] and [C].

14. The polishing pad according to 13 above, wherein the above-mentioned crosslinkable elastomer is 1,2-polybutadiene.

15. The composition for forming a polishing pad according to 13 above, wherein [C] is cyclodextrin.

16. A method for producing a polishing pad comprising:

a first step for kneading a formulation (I) comprising [A] a crosslinkable elastomer having no carboxyl, amino, hydroxyl, epoxy, sulfonic acid and phosphoric acid groups and [B] a water-insoluble substance having at least one functional group selected from the group consisting of carboxyl, amino, hydroxyl, epoxy, sulfonic acid and phosphoric acid groups, and a second step for molding into a polishing pad.

17. The method for producing a polishing pad according to 16 above, wherein the amount of [A] is 40 to 99.9 wt % and the amount of [B] is 0.1 to 60 wt %, based on 100 wt % of the total of [A] and [B].

18. The method for producing a polishing pad according to 17 above, further mixing the above-mentioned formulation (I) and [C] a water-soluble substance whose amount is 5 to 50 vol % based on 100 vol % of the total of [A], [B] and [C].

The polishing pad in the invention can be produced by using the composition for forming a polishing pad containing a substance having specific functional group. It exhibits satisfactory polishing performance and allows polishing surfaces to be polished with a high removal rate. The crosslinked body for a polishing pad in the invention is also useful for the aforementioned polishing pad.

DETAILED DESCRIPTION OF THE INVENTION

The composition for forming a polishing pad in the invention comprises [A] a crosslinkable elastomer having no carboxyl, amino, hydroxyl, epoxy, sulfonic acid and phosphoric acid groups and [B] a water-insoluble substance having at least one functional group selected from the group consisting of carboxyl, amino, hydroxyl, epoxy, sulfonic acid and phosphoric acid groups.

The "[A] crosslinkable elastomer" is not particularly limited, there may be mentioned diene-based elastomer such as 1,2-polybutadiene, butadiene rubber, isoprene rubber, acrylonitrile-butadiene rubber, styrene-butadiene rubber and styrene-isoprene rubber, ethylene-propylene rubber, acrylic rubber, silicone rubber, fluorine rubber, ethylene-vinyl acetate copolymer, ethylene-ethyl acrylate copolymer, ionomer and the like. These may be used alone or in combination of two or more.

As [A] described above, it is preferred to use a diene-based elastomer which can be easily crosslinked with organic peroxides. 1,2-polybutadiene is particularly preferred among diene-based elastomers above because it gives compositions with high hardness after crosslinking.

The "[B] water-insoluble substance" is not particularly restricted so long as it has at least one functional group from among carboxyl, amino, hydroxyl, epoxy, sulfonic acid and phosphoric acid groups and shows water-insoluble property. There may be used (1) inorganic particles of fumed silica or colloidal silica having the abovementioned functional groups, (2) modified polymers such as maleic anhydride-modified polyethylene, maleic anhydride-modified polypropylene, terminal hydroxyl polybutadiene and terminal carboxyl polybutadiene with the abovementioned functional groups, and (3) polymers polymerized using monomers having the abovementioned functional groups (including copolymers). These may be used alone or in combination of two or more. Among these, [B] is preferably a polymer from the standpoint of preventing scratches on wafers during polishing, and terminal hydroxyl polybutadiene and terminal carboxyl polybutadiene are particularly preferred.

As copolymers polymerized using monomers having functional groups there may be mentioned copolymers containing (a) an aliphatic conjugated diene monomer unit and (b) a monomer unit having one polymerizable unsaturated group and at least one functional group selected from the group consisting of carboxyl, amino, hydroxyl, epoxy, sulfonic acid and phosphoric acid groups, as the repeating units, or copolymers containing (a) and (b) above with (c) a monomer unit having at least two of polymerizable unsaturated groups.

As a monomer forming the aliphatic conjugated diene monomer unit (a) there may be mentioned 1,3-butadiene, isoprene, 2,3-dimethyl-1,3-butadiene, chloroprene and the like. These may be used alone or in combination of two or more.

Among a monomer which forms the monomer unit (b) having one polymerizable unsaturated group and at least one functional group selected from the group consisting of carboxyl, amino, hydroxyl, epoxy, sulfonic acid and phosphoric acid groups, there may be mentioned, as a monomer having carboxyl group, unsaturated carboxylic acids such as (meth)acrylic acid, maleic acid, fumaric acid, itaconic acid, tetraconic acid, cinnamic acid or the like, and free carboxyl group-containing esters including monoesters of non-polymerizable polyhydric carboxyl acids such as phthalic acid, succinic acid and adipic acid with hydroxyl-containing unsaturated compounds such as (meth)allyl alcohol and 2-hydroxyethyl (meth)acrylate, as well as their salt compounds. Among these, unsaturated carboxylic acids are preferred.

Preferred amino group-containing monomers are those with tertiary amino group. There may be mentioned dialkylaminoalkyl (meth)acrylates such as dimethylaminomethyl (meth)acrylate, diethylaminomethyl (meth)acrylate, 2-dimethylaminoethyl (meth)acrylate, 2-diethylaminoethyl (meth)acrylate, 2-(di-n-propylamino)ethyl (meth)acrylate, 2-dimethylaminopropyl (meth)acrylate, 2-diethylaminopropyl (meth)acrylate, 2-(di-n-propylamino) propyl (meth)acrylate, 3-dimethylaminopropyl (meth) acrylate, 3-diethylaminopropyl (meth)acrylate and 3-(di-n-propylamino)propyl (meth)acrylate; N-dialkylaminoalkyl group-containing unsaturated amides such as N-dimethylaminomethyl (meth)acrylamide, N-diethylaminomethyl (meth)acrylamide, N-(2-dimethylaminoethyl) (meth)acrylamide, N-(2-diethylaminoethyl) (meth)acrylamide, N-(2-dimethylaminopropyl) (meth)acrylamide, N-(2-diethylaminopropyl) (meth)acrylamide, N-(3-dimethylaminopropyl) (meth)acrylamide and N-(3-diethylaminopropyl) (meth)acrylamide; and tertiary amino group-containing vinyl aromatic compounds such as N,N-dimethyl-p-aminostyrene, N,N-diethyl-p-aminostyrene, dimethyl(p-vinylbenzyl)amine, diethyl(p-vinylbenzyl) amine, dimethyl(p-vinylphenethyl)amine, diethyl(p-vinylphenethyl)amine, dimethyl(p-vinylbenzyloxymethyl) amine, dimethyl[2-(p-vinylbenzyloxy)ethyl]amine, diethyl (p-vinylbenzyloxymethyl)amine, diethyl[2-(p-vinylbenzyloxy)ethyl]amine, dimethyl(p-vinylphenethyloxymethyl)amine, dimethyl[2-(p-vinylphenethyloxy)ethyl]amine, diethyl(p-vinylphenethyloxymethyl)amine, diethyl[2-(p-vinylphenethyloxy)ethyl]amine, 2-vinylpyridine, 3-vinylpyridine, 4-vinylpyridine and the like. Among these dialkylaminoalkyl (meth)acrylates and tertiary amino group-containing vinyl aromatic compounds are preferred.

As a monomer having hydroxyl group there may be mentioned hydroxyalkyl (meth)acrylates such as 2-hydroxyethyl (meth)acrylate, 2-hydroxypropyl (meth) acrylate, 3-hydroxypropyl (meth)acrylate, 2-hydroxybutyl (meth)acrylate, 3-hydroxybutyl (meth)acrylate and 4-hydroxybutyl (meth)acrylate; mono(meth)acrylates of polyalkyleneglycol (with 2–23 alkyleneglycol units, for example) such as polyethyleneglycol and polypropyleneglycol; hydroxyl group-containing unsaturated amines such as N-hydroxymethyl (meth)acrylamide, N-(2-hydroxyethyl) (meth)acrylamide and N,N-bis(2-hydroxyethyl) (meth) acrylamide; and hydroxyl group-containing vinyl aromatic compounds such as o-hydroxystyrene, m-hydroxystyrene, p-hydroxystyrene, o-hydroxy-α-methylstyrene, m-hydroxy-α-methylstyrene, p-hydroxy-α-methylstyrene, p-vinylbenzyl alcohol; (meth)allyl alcohol and the like. Among these, hydroxyalkyl (meth)acrylates and hydroxyl group-containing vinyl aromatic compounds are preferred.

As a monomer having epoxy group there may be mentioned (meth)allylglycidyl ether, glycidyl (meth)acrylate, 3,4-oxycyclohexyl (meth)acrylate and the like.

As a monomer having sulfonic acid group there may be mentioned (meth)acrylamide-based monomers such as 2-(meth)acrylamide ethanesulfonic acid, 2-(meth) acrylamide propanesulfonic acid, 3-(meth)acrylamide propanesulfonic acid, 2-(meth)acrylamide-2-methylpropanesulfonic acid, 3-(meth)acrylamide-2-methylpropanesulfonic acid and the like; (meth)acrylate-based monomers such as ethyl (meth)acrylate 2-sulfonate, propyl (meth)acrylate 2-sulfonate, propyl (meth)acrylate 3-sulfonate, ethyl (meth)acrylate 1,1-dimethyl-2-sulfonate and the like; vinyl aromatic compound-based monomers such as p-vinylbenzenesulfonic acid and p-isopropenylbenzenesulfonic acid, as well as their salt compounds.

As a monomer having phosphoric acid group there may be mentioned ethylene (meth)acrylate phosphate, trimethylene (meth)acrylate phosphate, tetramethylene (meth) acrylate phosphate, propylene (meth)acrylate phosphate, bis (ethylene(meth)acrylate) phosphate, bis(trimethylene(meth) acrylate) phosphate, bis(tetramethylene(meth)acrylate) phosphate, diethyleneglycol (meth)acrylate phosphate, triethyleneglycol (meth)acrylate phosphate, polyethyleneglycol (meth)acrylate phosphate, bis(diethyleneglycol(meth) acrylate) phosphate, bis(triethyleneglycol(meth)acrylate) phosphate and bis(polyethyleneglycol(meth)acrylate) phosphate, as well as their salt compounds. These listed as a monomer having one polymerizable unsaturated group and at least one functional group selected from the group consisting of a carboxyl group, an amino group, a hydroxyl group, an epoxy group, a sulfonic acid group and a phosphoric acid group may be used alone or in combination of two or more.

As the monomer which forms a monomer unit (c) having at least two polymerizable unsaturated groups there may be mentioned ethyleneglycol di(meth)acrylate, propyleneglycol di(meth)acrylate, 1,4-butanediol di(meth)acrylate, 1,6-hexanediol di(meth)acrylate, trimethylolpropane di(meth) acrylate, trimethylolpropane tri(meth)acrylate, pentaerythritol tri(meth)acrylate, pentaerythritol tetra(meth) acrylate, divinylbenzene, diisopropenylbenzene and trivinylbenzene. These may also be used alone or in combination of two or more.

The content of [A] and [B] above is preferably 40 to 99.9 wt %, more preferably 60 to 99.9 wt % and even more preferably 70 to 99.5 wt % for (A) and preferably 0.1 to 60 wt %, more preferably 0.1 to 40 wt % and even more preferably 0.5 to 30 wt % for [B], based on 100 wt % of the total of [A] and [B]. The content less than 0.1 wt % of [B], a sufficient effect of improving the removal rate may not be achieved. On the other hand, the content exceeding 60 wt % of [B] leads the effect of improving removal rate saturated and reduced moldability or strength of the polishing pad formed using the composition however it depends on the substances included.

The composition for forming a polishing pad in the invention generally comprise a crosslinking agent for the purpose of crosslinking at least [A] among [A] and [B] above. The crosslinking agent is not particularly restricted, the organic peroxide is preferable. In the case of polishing of semiconductor wafer and the like, impurities such as sulfur are undesirable and the crosslinking agent containing sulfur is not preferable.

When the crosslinked body and the polishing pad are formed by using the composition for forming a polishing pad in the invention, [B] above may be dispersed in the matrix formed by crosslinking [A] above, or form a matrix material by co-crosslinking with [A].

The composition for forming a polishing pad in the invention may further comprise the "[C] water-soluble substance".

Above-mentioned [C] is one that can be released from the surface of the matrix material upon contact with water. Thus, the water-soluble substances include substances that dissolve in water such as water-soluble polymers, as well as those which swell and be a gel-like by contacting with water, such as water-absorbing resins. The water-soluble substance may also be one which dissolves or swells in a medium composed mainly of water but also containing methanol or the like. The water-soluble substance is normally dispersed in the matrix material.

The water-soluble substance above may be an organic-based and/or an inorganic-based water-soluble substance.

The organic-based water-soluble substance may be used dextrin, cyclodextrin, mannit, sugars (lactose, etc.), celluloses (hydroxypropyl cellulose, methyl cellulose, etc.), starch, protein, poly vinyl alcohol, poly vinyl pyrrolidone, poly vinyl sulfonic acid, polyacrylic acid, polyethylene oxide, water-soluble photosensitive resins, sulfonated polyisoprenes and the like. Among these, cyclodextrin is preferred.

As inorganic-based water-soluble substances there may be mentioned potassium acetate, potassium nitrate, potassium carbonate, potassium hydrogen carbonate, potassium bromide, potassium phosphate, potassium sulfate, magnesium sulfate and calcium nitrate. Among these, potassium sulfate is preferred. These listed as the water-soluble substance may be used alone or in combinations of two or more. And also, the organic-based and the inorganic-based may be used in combination as well.

When necessary in order to inhibit elution of the water-soluble substance, the water-soluble substance may be subjected to coupling treatment and/or coating treatment.

The shape of the water-soluble substance is not particularly limited. The mean particle size is preferably 0.1 to 500 $\mu$m and more preferably 0.5 to 100 $\mu$m. If the mean particle size is less than 0.1 $\mu$m, the resulting pores are so small that it is not possible to obtain a polishing pad that can adequately hold the abrasive. On the other hand, exceeding 500 $\mu$m of the mean particle size leads to reduced mechanical strength of the polishing pad. The mean particle size is defined as the average value of the maximal length of the water-soluble substance.

The content of the water-soluble substance [C] is preferably 5 to 50 vol %, more preferably 10 to 45 vol % and even more preferably 20 to 40 vol % based on 100 vol % of the total of [A], [B] and [C]. If the content of [C] is less than 5 vol %, the resulting pores in the polishing pad are not sufficiently formed, and the removal rate may tend to be reduced. On the other hand, if the content is exceeding 50 vol % it may not be possible to maintain proper values of hardness and mechanical strength of the polishing pad.

When the crosslinked body for a polishing pad or the polishing pad is formed by using the composition for forming a polishing pad containing [C] above, the water-soluble substance [C] is dispersed and contained throughout the entirety of the matrix material. Pores are formed by elution of the water-soluble substance on the uppermost surface of the polishing pad obtained from the polishing pad composition, when it contacts with water in polishing a polished object with the polishing pad. The pores hold slurry and function to temporarily retain the polishing scrap. The average size of the pore formed after release of the water-soluble substance [C] from the polishing pad is preferably 0.1 to 500 $\mu$m and more preferably 0.5 to 100 $\mu$m. The water-soluble substance [C] contacts with the aqueous medium slurry or water in dressing on the polishing pad, thus dissolving and swelling, and being released from the matrix material.

The water-soluble substance [C] preferably only dissolves in water when exposed on the surface layer in the polishing pad, without absorbing moisture or swelling inside the polishing pad. The water-soluble substance therefore preferably has an outer shell on at least a portion of its exterior which inhibits moisture absorption. The outer shell may be physically attached to the water-soluble substance, chemically bonded to the water-soluble substance or in contact with the water-soluble substance in both ways. As materials that form such an outer shell there may be mentioned epoxy resins, polyimides, polyamides, polysilicates and the like. The outer shell may be formed over only a portion of the water-soluble substance and still provide an adequate effect.

In addition to the function of forming the pores, the water-soluble substance also has a function of increasing the intrusion hardness of the polishing pad (for example, to Shore D hardness of 35 to 100). A larger intrusion hardness will allow increased pressure of the polishing pad to be applied to polishing surfaces. This will not only improve the removal rate but also give higher flatness at the same time. Thus, it is particularly preferred for the water-soluble substance to be a solid that can ensure an adequate intrusion hardness for the polishing pad.

The composition for forming a polishing pad in the invention composition of the invention may also contain abrasive particles (composed silica, alumina, ceria, zirconia, titania and the like), oxidants, alkali metal hydroxides and acids, pH adjustors, surfactants, scratch-resistant agents and the like that are included in conventional slurries in addition to the water-soluble substance. This will allow polishing to be carried out by supplying only water when polishing with the polishing pad formed using the composition containing the above components.

As examples of specific oxidizing agents there may be mentioned hydrogen peroxide, organic peroxides such as peracetic acid, perbenzoic acid, tert-butylhydroperoxide, and the like, permanganate compounds such as potassium permanganate, and the like, bichromate compounds such as potassium bichromate, and the like, halogenate compounds such as potassium iodate, and the like, nitric compounds such as nitric acid, iron nitrate, and the like, perhalogenate compounds such as perchloric acid, and the like, transition metal salts such as potassium ferricyanide, and the like, persulfuric compounds such as ammonium persulfate, and the like, and heteropoly acids. Particularly preferred among these oxidizing agents are hydrogen peroxide and organic peroxides which contain no metals and whose decomposition products are harmless. The oxidizing agents above may be used alone or in combination of two or more.

As alkali metal hydroxides there may be used sodium hydroxide, potassium hydroxide, rubidium hydroxide, cesium hydroxide and the like. These alkali metal hydroxides may be used alone or in combination of two or more.

And an acid is not particularly restricted, and any organic acid or inorganic acid may be used. As organic acids there may be mentioned para-toluenesulfonic acid, dodecylbenzenesulfonic acid, isoprenesulfonic acid, gluconic acid, lactic acid, citric acid, tartaric acid, malic acid, glycolic acid, malonic acid, formic acid, oxalic acid, succinic acid, fumaric acid, maleic acid and phthalic acid. These organic acids may be used alone or in combinations of two or more. As inorganic acids there may be mentioned nitric acid, hydrochloric acid and sulfuric acid, and any one or more of these may be used. An organic acid and an inorganic acid may also be used in combination.

As surfactants there may be used cationic surfactants, anionic surfactants or non-ionic surfactants. As cationic surfactants there may be mentioned fatty amines, aliphatic ammonium salts and the like. As anionic surfactants there may be mentioned carboxylic acid salts such as fatty acid soaps and alkylether carboxylic acid salts, sulfonic acid salts such as alkylbenzenesulfonic acid salts, alkylnaphthalenesulfonic acid salts and a-olefinsulfonic acid salts, sulfuric acid ester salts such as higher alcohol sulfuric acid ester salts and alkylether sulfuric acid salts, and phosphoric acid esters such as alkylphosphoric acid esters and the like. These surfactants may be used alone or in combination of two or more.

A porous polishing pad can be obtained by incorporating a foaming agent, hollow particles and the like. The foaming agent may be used a chemical foaming agent and a physical foaming agent. As chemical foaming agents there may be mentioned azo compounds such as azodicarboxylic acid amide, nitroso compounds such as N,N'-dinitroso pentamethylene tetramine, and hydrazin derivatives such as 4,4'-oxybis(benzenesulfonylhydrazide). As physical foaming agents there may be mentioned water, nitrogen gas, carbon dioxide and the like. As hollow particles there may be mentioned "Expanyal" produced by Japan Filight CO., LTD.

The composition for forming a polishing pad in the invention may, if necessary, also incorporate various additives such as fillers, softeners, antioxidants, ultraviolet absorbers, antistatic agents, lubricants, plasticizers and the like. As fillers there may be used materials that improve rigidity such as calcium carbonate, magnesium carbonate, talc and clay, or materials that give a polishing effect, such as manganese dioxide, manganese trioxide and barium carbonate.

There are no particular restrictions on the method of producing the composition for forming a polishing pad. For example, it can be obtained by mixing [A], [B] above, [C] above and other additives incorporated if necessary, and kneading. The water-soluble substance [C] is preferably solid-state when incorporating. So long as it is a solid, the water-soluble substance can easily disperse with the aforementioned preferred mean particle size regardless of the degree of compatibility with the crosslinked body of at least [A] among [A] and [B] above, and can make processability of the polishing pad higher. Thus, it is preferred to select the type of water-soluble substance [C] in consideration of the kneading temperature of the [A] and [B] used. For the purpose of producing a composition containing a crosslinking agent, the mixture is preferably kneaded at the temperature not occuring crosslinking reaction. Kneader in producing the composition may be used rollers, kneaders, Banbury mixers, extruders (single-screw, multiple-screws) and the like.

The crosslinked body in the invention is one made up with the composition for forming a polishing pad above. It may be fixed or variable. In the case of producing a fixed form, the desired shape such as that of a sheet, block or film, by press molding, extrusion molding, injection molding and the like can be obtained. A polishing pad will be obtained by processing the material to the desired size.

The polishing pad in the invention can be manufactured by introducing the composition for forming a polishing pad above to the metal mold.

Shore D hardness of the polishing pad is preferably 35 or more, more preferably 50 to 90, and most preferably 60 to 85, but it is usually no greater than 100. Shore D hardness less than 35 leads to lower pressure applied to polishing surfaces during polishing, and the removal rate is reduced while the polishing flatness may also be inadequate.

The surface of the polishing pad (the polishing side) may be formed to the desired shape if necessary with a grid-like, helical, concentric and radial grooves and dot pattern, for the purpose of improving the discharging property of the slurry. To form grooves on the surface of the polishing pad, any of machining method such as cutting work, forming method using the metal mold having the template of the grooves and the like is selected. And the polishing pad may be the one which a softer layer is attached to the back side of the polishing pad (the side opposite the polishing side), and be given a multilayer structure. The shape of the polishing pad is not particularly restricted, and any appropriate shape, such as a disk, belt or roller shape, may be selected depending on the polishing apparatus.

DESCRIPTION OF THE PREFERRED EMBODIMENTS

The present invention is further described in the following examples.

[1] Preparation of Composition and Formation of Polishing Pad

EXAMPLE 1

99 wt % of (a) 1,2-polybutadiene (JSR CORP., trade name: "JSR RB830"), 1 wt % of (b) polybutadiene with hydroxyl groups at both ends (NIPPON SODA CO., LTD., trade name: "NISSO-PB G3000") and β-cyclodextrin (YOKOHAMAKOKUSAI BIOKENKYUJO CO., LTD., trade name: "Dexypearl β-100", mean particle size is about 20 μm.) were incorporated and kneaded in the kneader heated to 120° C. The content of (c) the water-soluble substance was 30 vol % based on the total of (a), (b) and (c) above.

After that, 1 part by weight of organic peroxide (NIPPON OIL & FATS CO., LTD., trade name "Percumyl D40") was added to 100 parts by weight of the total of (a) and (b). And by further kneading a composition (I) was prepared. After crosslinking reaction was carried out at 170° C. for 15 minutes in a mold for shaping using the composition (I), a disk-shaped polishing pad with a diameter of 60 cm and a thickness of 2 mm was obtained.

EXAMPLE 2

Using sodium lauryl sulfate as an emulsifier and benzoyl peroxide as a polymerization initiator, monomers in a proportion of butadiene/acrylonitrile/methacrylic acid/2-hydroxybutyl methacrylate/ethyleneglycol dimethacrylate/divinylbenzene=62/20/5/11/1/2 (mole percent) were subjected to emulsion polymerization. The conversion was approximately 100%. Next, the resulting copolymer emulsion was then solidified and dried to prepare a (d) functional group-containing copolymer.

After that, 90 wt % of the above-mentioned (a) 1,2-polybutadiene, 8 wt % of (e) polybutadiene rubber (JSR CORP., trade name: "BR01"), 2 wt % of the above-mentioned (d) functional group-containing copolymer and the above-mentioned (c) water-soluble substance were mixed and kneaded in the kneader heated to 120° C. The content of (c) the water-soluble substance was 30 vol % based on the total of (a), (d), (e) and (c) above. And then, 1 part by weight of the organic peroxide used in Example 1 based on 100 parts by weight of the total of (a), (d), (e) and (c) was added to the kneaded material and further kneaded to prepare a composition (II). A polishing pad was obtained using the composition (II) in the same manner as Example 1.

EXAMPLE 3

95 wt % of the above-mentioned (a) 1,2-polybutadiene and 5 wt % of the above-mentioned (b) polybutadiene with hydroxyl groups at both ends were mixed and kneaded in the kneader heated to 120° C. After that 1 part by weight of the above-mentioned organic peroxide based on 100 parts by weight of the total of (a) and (b) was added to the kneaded material and further kneaded to prepare a composition. A polishing pad was obtained using the composition in the same manner as Example 1.

Comparative Example 1

70 vol % of the above-mentioned (a) 1,2-polybutadiene and 30 vol % of the above-mentioned (c) water-soluble substance were mixed and kneaded in the kneader heated to 120° C. After that 1 part by weight of the above-mentioned organic peroxide based on 100 parts by weight of (a) was added to the kneaded material and further kneaded to prepare a composition (III). A polishing pad was obtained using the composition (III) in the same manner as Example 1.

Comparative Example 2

92 wt % of the above-mentioned (a) 1,2-polybutadiene, 8 wt % of the above-mentioned (e) polybutadiene rubber and 30 vol % of the above-mentioned (c) water-soluble substance based on the total of (a), (e) and (c) were mixed and kneaded in the kneader heated to 120° C. After that 1 part by weight of the above-mentioned organic peroxide based on 100 parts by weight of the total of (a), (e) and (c) was added to the kneaded material and further kneaded to prepare a composition (IV). A polishing pad was obtained using the composition (IV) in the same manner as Example 1.

Comparative Example 3

30 wt % of the above-mentioned (a) 1,2-polybutadiene, 70 wt % of the above-mentioned (d) functional group-containing copolymer and 30 vol % of the above-mentioned (c) water-soluble substance based on the total of (a), (d) and (c) were mixed and kneaded in the kneader heated to 120° C. After that 1 part by weight of the above-mentioned organic peroxide based on 100 parts by weight of the total of (a), (d) and (c) was added to the kneaded material and further kneaded to prepare a composition (V). A polishing pad was obtained using the composition (V) in the same manner as Example 1.

[2] Evaluation of Polishing Performance

Respective polishing pads obtained in Examples 1 to 3 and Comparative Examples 1 to 3 were mounted on a surface plate of a polishing machine (SFT CORP., model "Lapmaster LGP510"), and a silica membrane wafer was polished under the conditions of the flat surface rotation number of 50 rpm and the slurry flow rate of 100 ml/min. to assess the difference in the polishing performance of each polishing pad and the result thereof are shown Table 1. The removal rate was obtained by measuring a change in a membrane thickness with an optical membrane thickness measuring machine.

TABLE 1

| | Example | | | Comparative example | | |
|---|---|---|---|---|---|---|
| | 1 | 2 | 3 | 1 | 2 | 3 |
| Removal rate (Å/min) | 1340 | 1440 | 1250 | 1080 | 1120 | 1280 |

According to Table 1, the removal rates using the polishing pads of Comparative Examples 1 and 2 which contained no substances with functional groups such as hydroxyl groups were 1080 and 1120 Å/min, respectively. The removal rate of Comparative Example 3 was improved a little, but the polishing pad was fragile and has some cracks and lacking on the surface. In contrast, the removal rates with the polishing pads of Examples 1 and 2 which contained substances with functional groups such as hydroxyl groups were 1340 and 1440 Å/min, respectively, representing a removal rate improvement of about 20–30% over the comparative examples, and therefore demonstrated to exhibit superior polishing performance.

What is claimed is:

1. A composition for forming a polishing pad comprising [A] a crosslinkable elastomer having no carboxyl, amino, hydroxyl, epoxy, sulfonic acid or phosphoric acid groups, [B] a water-insoluble substance having at least one functional group selected from the group consisting of carboxyl, amino, hydroxyl, epoxy, sulfonic acid and phosphoric acid groups, and [C] a water-soluble substance.

2. The composition according to claim 1, wherein the amount of [C] is 5 to 50 vol % based on 100 vol % of the total of [A], [B] and [C].

3. The composition according to claim 1, wherein [C] is cyclodextrin.

4. The composition according to claim 3, wherein said crosslinkable elastomer is 1,2-polybutadiene.

5. A polishing pad obtained from a composition comprising [A] a crosslinkable elastomer having no carboxyl, amino, hydroxyl, epoxy, sulfonic acid or phosphoric acid groups, [B] a water-insoluble substance having at least one functional group selected from the group consisting of carboxyl, amino, hydroxyl, epoxy, sulfonic acid and phosphoric acid groups, and [C] a water-soluble substance.

6. The polishing pad according to claim 5, wherein the amount of [C] is 5 to 50 vol % based on 100 vol % of the total of [A], [B] and [C].

7. The polishing pad according to claim 5, wherein [C] is cyclodextrin.

8. The polishing pad according to claim 7, wherein said crosslinkable elastomer is 1,2-polybutadiene.

9. A method for producing a polishing pad comprising;

(1) kneading a formation (I) comprising [A] a crosslinkable elastomer having no carboxyl, amino, hydroxyl, epoxy, sulfonic acid or phosphoric acid groups, [B] a water-insoluble substance having at least one functional group selected from the group consisting of carboxyl, amino, hydroxyl, epoxy, sulfonic acid and phosphoric acid groups, and [C] a water-soluble substance whose amount is 5 to 50 vol % based on 100 vol % of the total of [A], [B] and [C], (2) molding into a polishing pad, and (3) crosslinking.

10. The method according to claim 9, wherein the amount of [A] is 40 to 99.9 wt % and the amount of [B] is 0.1 to 60 wt %, based on 100 wt % of the total of [A] and [B].

11. A composition for forming a polishing pad comprising [A] a crosslinkable elastomer having no carboxyl, amino, hydroxyl, epoxy, sulfonic acid or phosphoric acid groups, and [B] a water-insoluble polymer having at least one functional group selected from the group consisting of carboxyl, amino, hydroxyl, epoxy, sulfonic acid and phosphoric acid groups, wherein, when crosslinking said composition, [B] forms a matrix material by co-crosslinking with [A].

12. The composition according to claim 11, wherein said polymer is at least one polymer selected from the group consisting of maleic anhydride-modified polyethylene, maleic anhydride-modified polypropylene, terminal hydroxyl polybutadiene and terminal carboxyl polybutadiene, and/or polymer comprising a monomer unit having at least one functional group selected from the group consisting of carboxyl, amino, hydroxyl, epoxy, sulfonic acid and phosphoric acid groups and at least one monomer unit selected from the group consisting of 1,3-butadiene, isoprene, 2,3-dimethyl-1,3-butadiene and chloroprene.

13. The composition according to claim 12, wherein the amount of [A] is 40 to 99.9 wt % and the amount of [B] is 0.1 to 60 wt %, based on 100 wt % of the total of [A] and [B].

14. The composition according to claim 13, wherein said crosslinkable elastomer is 1,2-polybutadiene.

15. The composition according to claim 11, wherein said [A] crosslinkable elastomer is 1,2-polybutadiene, and said [B] polymer is polymer comprising a monomer unit having at least one functional group selected from the group consisting of carboxyl, amino, hydroxyl, epoxy, sulfonic acid and phosphoric acid groups, and at least one monomer unit selected from the group consisting of 1,3-butadiene, isoprene, 2,3-dimethyl-1,3-butadiene and chloroprene.

16. The composition according to claim 11, which does not contain abrasive particles.

17. The composition according to claim 16, wherein said [A] crosslinkable elastomer is 1,2-polybutadiene, and said [B] polymer is polymer comprising a monomer unit having at least one functional group selected from the group consisting of carboxyl, amino, hydroxyl, epoxy, sulfonic acid and phosphoric acid groups, and at least one monomer unit selected from the group consisting of 1,3-butadiene, isoprene, 2,3-dimethyl-1,3-butadiene and chloroprene.

18. A polishing pad obtained by crosslinking a composition comprising [A] a crosslinkable elastomer having no carboxyl, amino, hydroxyl, epoxy, sulfonic acid or phosphoric acid groups, [B] a water-insoluble polymer having at least one functional group selected from the group consisting of carboxyl, amino, hydroxyl, epoxy, sulfonic acid and phosphoric acid groups, and [D] a crosslinking agent, wherein [B] forms a matrix by co-crosslinking with [A].

19. The polishing pad according to claim 18, wherein said polymer is at least one polymer selected from the group consisting of maleic anhydride-modified polyethylene, maleic anhydride-modified polypropylene, terminal hydroxyl polybutadiene and terminal carboxyl polybutadiene, and/or polymer comprising a monomer unit having at least one functional group selected from the group consisting of carboxyl, amino, hydroxyl, epoxy, sulfonic acid and phosphoric acid groups, and at least one monomer unit selected from the group consisting of 1,3-butadiene, isoprene, 2,3-dimethyl-1,3-butadiene and chloroprene.

20. The polishing pad according to claim 19, wherein the amount of [A] is 40 to 99.9 wt % and the amount of [B] is 0.1 to 60 wt %, based on 100 wt % of the total of [A] and [B].

21. The polishing pad according to claim 20, wherein said crosslinking elastomer is 1,2-polybutadiene.

22. The polishing pad according to claim 18, wherein said [A] crosslinkable elastomer is 1,2-polybutadiene, and said [B] polymer is polymer comprising a monomer unit having at least one functional group selected from the group consisting of carboxyl, amino, hydroxyl, epoxy, sulfonic acid and phosphoric acid groups, and at least one monomer unit selected from the group consisting of 1,3-butadiene, isoprene, 2,3-dimethyl-1,3-butadiene and chloroprene.

23. The polishing pad according to claim 18, which does not contain abrasive particles.

24. The polishing pad according to claim 23, wherein said [A] crosslinkable elastomer is 1,2-polybutadiene, and said [B] polymer is polymer comprising a monomer unit having at least one functional group selected from the group consisting of carboxyl, amino, hydroxyl, epoxy, sulfonic acid and phosphoric acid groups, and at least one monomer unit selected from the group consisting of 1,3-butadiene, isoprene, 2,3-dimethyl-1,3-butadiene and chloroprene.

25. A method for producing a polishing pad comprising:

(1) kneading a formulation (I) comprising [A] a crosslinkable elastomer having no carboxyl, amino, hydroxyl, epoxy, sulfonic acid or phosphoric acid groups, [B] a water-insoluble substance having at least one functional group selected from the group consisting of carboxyl, amino, hydroxyl, epoxy, sulfonic acid and phosphoric acid groups and [D] a crosslinking agent, (2) molding into a polishing pad, and (3) crosslinking.

26. A method for producing a polishing pad according to claim 25, wherein said [B] polymer is at least one polymer selected from the group consisting of maleic anhydride-modified polyethylene, maleic anhydride-modified polypropylene, terminal hydroxyl polybutadiene and terminal carboxyl polybutadiene, and/or polymer comprising a monomer unit having at least one functional group selected from the group consisting of carboxyl, amino, hydroxyl, epoxy, sulfonic acid and phosphoric acid groups, and at least one monomer unit selected from the group consisting of 1,3-butadiene, isoprene, 2,3-dimethyl-1,3-butadiene and chloroprene.

27. The method according to claim 26, wherein said [A] crosslinkable elastomer is 1,2-polybutadiene, and said [B] polymer is polymer comprising a monomer unit having at least one functional group selected from the group consisting of carboxyl, amino, hydroxyl, epoxy, sulfonic acid and phosphoric acid groups and at least one monomer unit selected from the group consisting of 1,3-butadiene, isoprene, 2,3-dimethyl-1,3-butadiene and chloroprene.

28. The method according to claim 25, wherein the formulation does not contain abrasive particles.

29. The method according to claim 28, wherein said [A] crosslinkable elastomer is 1,2-polybutadiene, and said [B] polymer is polymer comprising a monomer unit having at least one functional group selected from the group consisting of carboxyl, amino, hydroxyl, epoxy, sulfonic acid and phosphoric acid groups, and at least one monomer unit selected from the group consisting of 1,3-butadiene, isoprene, 2,3-dimethyl-1,3-butadiene and chloroprene.

30. A composition for forming a polishing pad comprising [A] a crosslinkable elastomer having no carboxyl, amino, hydroxyl, epoxy, sulfonic acid or phosphoric acid groups, and [B] a water-insoluble substance having at least one functional group selected from the group consisting of carboxyl, amino, hydroxyl, epoxy, sulfonic acid and phosphoric acid groups, wherein said composition does not contain abrasive particles.

31. The composition according to claim 30, wherein said crosslinkable elastomer is 1,2-polybutadiene.

* * * * *